United States Patent [19]

Koizumi

[11] Patent Number: 4,592,644

[45] Date of Patent: Jun. 3, 1986

[54] COPYING MACHINE USING A PHOTOSENSITIVE BELT

[75] Inventor: Yutaka Koizumi, Kawasaki, Japan

[73] Assignee: Ricoh Company, Ltd., Japan

[21] Appl. No.: 600,466

[22] Filed: Apr. 16, 1984

[30] Foreign Application Priority Data

Apr. 15, 1983 [JP] Japan ..... 58-66804

[51] Int. Cl.[4] ..... G03G 15/00

[52] U.S. Cl. ..... 355/3 BE; 355/16

[58] Field of Search ..... 355/3 R, 3 DR, 3 BE, 355/16, 8

[56] References Cited

U.S. PATENT DOCUMENTS 3,974,974 8/1976 Nishikawa ..... 355/16 X 4,341,464 7/1982 Vola ..... 355/3 BE X

*Primary Examiner*—Arthur T. Grimley

*Assistant Examiner*—J. Pendegrass

*Attorney, Agent, or Firm*—Guy W. Shoup

[57] ABSTRACT

A copying machine includes a detachably mountable cassette which includes a photosensitive web as extending between a take-up roller and a supply roller provided in the cassette. The photosensitive web includes an imaging section which corresponds in length to transfer paper of maximum size usable in the copying machine and leading and trailing sections on both sides of the imaging section. Since the web is relatively short in length, it travels substantially at constant speed between the take-up and supply rollers so that there is no need to provide an extra device for maintaining a constant speed.

8 Claims, 5 Drawing Figures

COPYING MACHINE USING A PHOTOSENSITIVE BELT

BACKGROUND OF THE INVENTION

1. Field of the Invention

This invention generally relates to a copying machine and particularly to a copying machine which uses a photosensitive belt. More specifically, the present invention relates to a copying machine using a cassette type photosensitive belt which may be detachably installed.

2. Description of the Prior Art

Copying machines using cassette type photosensitive belts or webs are well known in the art. For example, as disclosed in the Japanese Patent Pub. No. 49-22660 and Utility Model Laid-open Pub. No. 50-31935, in the prior art machines, use has been made of a significantly long photosensitive belt extended between a pair of spools. With such a structure, the belt may be used for a long period of time and thus the need for replacement arises less frequently. However, since the photosensitive belt is significantly long, the diameter of the belt when wound around the spool is relatively large, thereby making the cassette larger in size and producing a loss in time required for rewinding or change in direction of the cassette. Moreover, since the diameter of the belt wound around the spool changes significantly between the start and the end of operation, it is required to specially provide a constant speed driving device or feedback device for constant speed motion for moving the photosensitive belt always at constant speed from the supply spool to the take-up spool, which tends to complicate the structure.

Prior art copying machines using relatively short photosensitive belts are disclosed, for example, in Japanese Patent Pub. No. 52-80843, Utility Model Pub. No. 53-50441 and Patent Laid-open Pub. No. 49-44756. However, in these prior art machines, the cassette is comprised of two separate bodies or the photosensitive belt must be directly set in position, so that handling of the photosensitive belt is poor and replacement of photosensitive belts is cumbersome. Besides, in association with the movement of the photosensitive belt, other elements such as take-up roller and charger must also be moved, so that the layout of various elements of a copier is rather limited, thereby making the machine complicated in structure and hindering to attain a high speed operation.

SUMMARY OF THE INVENTION

It is therefore a primary object of the present invention to provide an improved copying machine.

Another object of the present invention is to provide an improved copying machine using a belt-type or web-type photosensitive member.

A further object of the present invention is to provide a copying machine using a cassette type photosensitive belt.

A still further object of the present invention is to provide a copying machine using a photosensitive belt, which is simple in structure, easy to manufacture and excellent in maneuverability.

A still further object of the present invention is to provide a copying machine capable of moving a photosensitive belt at constant speed during operation without requiring the provision of a special constant speed driving device.

A still further object of the present invention is to provide a copying machine using a cassette type photosensitive belt, which may be easily installed in position or detached.

Other objects, advantages and novel features of the present invention will become apparent from the following detailed description of the invention when considered in conjunction with the accompanying drawings.

DESCRIPTION OF THE PREFERRED EMBODIMENTS

Figure 1:
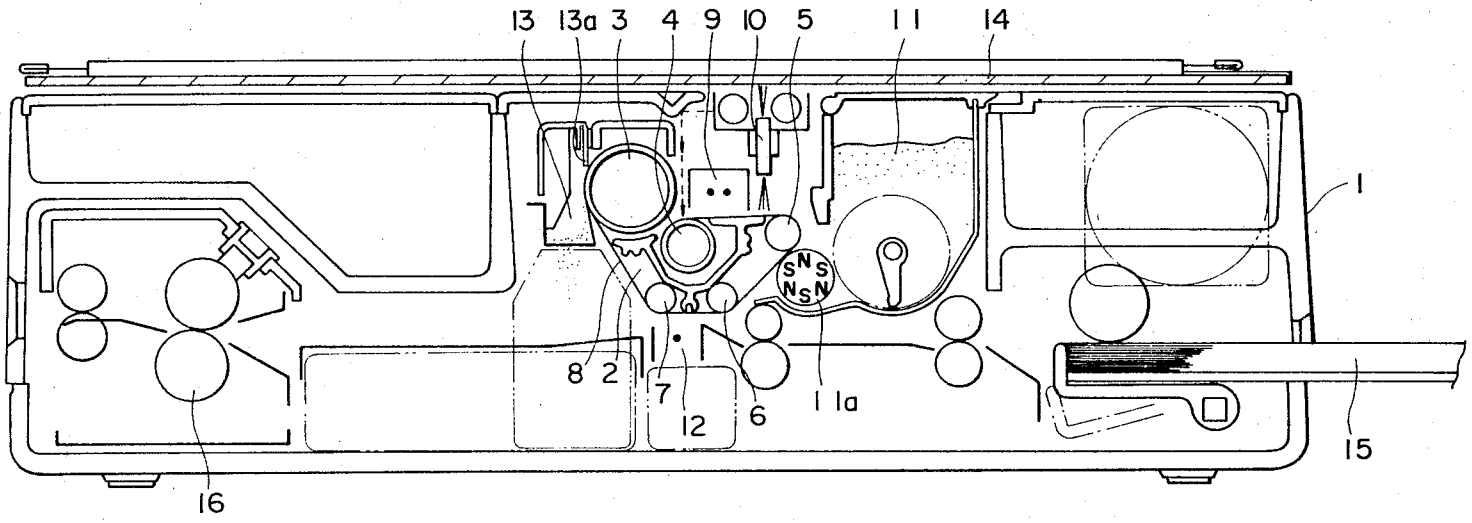
FIG. 1 is a schematic side-elevational view showing the overall structure of a copying machine constructed in accordance with one embodiment of the present invention.
Figure 2:
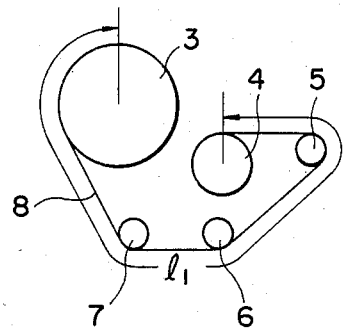
FIG. 2 is a schematic illustration showing the structure for operating the photosensitive belt in the copying machine of FIG. 1.

Referring now to FIG. 1, there is schematically shown the overall structure of a copying machine 1 constructed in accordance with one embodiment of the present invention. Approximately at the center of the copying machine 1 is disposed a photosensitive belt cassette 2 as detachably mounted therein. The cassette 2 includes a take-up roller 3, a supply roller 4 disposed in the vicinity of the take-up roller 3 and intermediate rollers 5, 6 and 7 which are disposed generally around the supply roller 4. And, a photosensitive belt 8 is extended between the take-up roller 3 and the supply roller 4 as passed around the intermediate rollers 5, 6 and 7. Thus, one end of the photosensitive belt 8 is fixedly attached to the take-up roller 3 and the other end is fixedly attached to the supply roller 4. The intermediate rollers 5, 6 and 7 are provided so as to guide the movement of the photosensitive belt 8 along a main charger 9, an image exposure system 10, a developing device 11, an image transfer device 12 and a cleaning device 13 provided in the main housing of the copier 1.

Thus, in operation, when a contact glass 14 with an original placed thereon is moved horizontally, the photosensitive belt 8 is advanced at the same speed as being wound around the take-up roller 3, during which the belt 8 is uniformly charged by the main charger 9 and then exposed to a light image of original through the exposure system 10 thereby forming an electrostatic latent image on the belt 8. The latent image is then developed by the developing device 11 and the developed image is then transferred by the transfer device 12 to a transfer medium 15 which is transported in association with the movement of the belt 8. Thereafter, the transfer medium 15 moves past a fixing device 16 whereby the transferred image becomes fixed on the transfer medium 15. The developing device 11 includes a developing roller 11*a* and thus so-called touch down development may be carried out. Furthermore, separation of the transfer medium 15 from the photosensitive belt 8 may be carried out utilizing a particular radius of curvature of the intermediate roller 7, and, in this case, no special separating device needs to be provided, which contributes to prevent a spotty image from being produced.

In the illustrated embodiment, the belt 8 has a particular length from end to end and it includes a first length section, which corresponds in length to transfer medium 15 having a maximum size (e.g., A3 size), a second length section provided between the take-up roller 3 and one end of the first length section and a third length section provided between the supply roller 4 and the other end of the first length section. Thus, with such a structure, the web-type photosensitive member 8 is moved back and forth between the supply roller 4 and the take-up roller 3 for each copy cycle. Accordingly, when combined with the scanning type exposure optical system 10, a copying operation may be carried out at the same timing as in the case in which a photosensitive drum is used instead of the web or belt. In the present embodiment, since the photosensitive belt 8 is short in length, the diameter of the belt 8 when wound around the take-up roller 3 or supply roller 4 does not change significantly so that the belt 8 travels substantially at constant speed. Moreover, both of the rollers 3 and 4 may be disposed closer together thereby allowing to make the overall structure of the cassette 2 compact in size. In addition, there is a greater degree of freedom in arranging the various elements of the cassette 2. For example, length, angle and other conditions required by the copying process devices may be easily secured, for example, by rearranging the intermediate rollers 5, 6 and 7.

In general, when a web or sheet is wound around a take-up roller by having the take-up roller driven to rotate at constant speed, the travelling speed of the web or sheet gradually increases, as is well known in a film projector, tape recorder and the like. In order to cope with this, the prior art machines required the provision of a constant speed driving device and the like for insuring that the web or sheet travels at constant speed. On the other hand, in accordance with the present embodiment, no special device for insuring a constant travelling speed of web or sheet is required to be provided and the take-up roller 3 may be directly driven to rotate to cause the belt 8 to travel in an intended direction substantially at constant speed. In the present embodiment, changes in travelling speed of the photosensitive belt 8 due to changes in the diameter of the belt 8 wound around the roller 3 may be maintained within ±0.5%. Thus, the travelling speed of belt 8 may be regarded as substantially constant. This aspect will be considered further in detail below.

The diameter R of the belt 8 wound around a roller may be approximately expressed as $$R = \sqrt{R_0^2 + t \cdot L/\pi} \quad . \tag{1}$$

Here,
$R_0$: reference diameter,
t: thickness of belt 8, and
L: length of belt 8.

If there occurs an increase of diameter by $\beta$%, then substitution of $R = R_0(1+\beta)$ in equation (1) and modification yields $$R_0 = \sqrt{t \cdot L/\beta\,(2+\beta)\,\pi} \quad . \tag{2}$$

As a specific example, substitution of specific values of $\beta = 0.01$, $t = 0.095$ mm (In this embodiment, the belt 8 is comprised of a base layer of 0.075 mm in thickness and a photoconductive layer of 0.02 mm in thickness.) and $L = 420$ mm (lengthwise size of A3 paper) into equation (2) yields $$R_0 = 25.137 \text{ mm.}$$

Thus, if the reference diameter is set larger than the above-described value and the difference in travelling speed of belt 8 is so set that this value of $R_0$ is reached at the center of A3 sized transfer medium, the difference in travelling speed between the start and the end of belt take-up operation may be maintained within ±0.5%, and, thus, it may be practically considered as constant speed. For example, if the take-up roller 3 is 30 mm in diameter, changes in travelling speed of the belt 8 may be maintained within ±0.35%.

Now, it will be considered as to the case in which the photosensitive belt 8 is taken up at constant speed and rewound at high speed. Upon entering into a copying operation, the photosensitive belt 8 wound around the supply roller 4 is gradually unwound and wound around the take-up roller 3 as the take-up roller 3 is driven to rotate. As the photosensitive belt 8 travels in this manner, various copying process steps, such as image forming and transferring, are carried out to the belt 8. During such operation, it is important that the belt 8 be kept in tension; otherwise, the belt becomes slacked or floated thereby hindering to obtain an appropriate contact pressure at the developing region, which could cause irregularities in the resulting image. Thus, when the belt 8 is to be taken up by the take-up roller 3, the supply roller 4 must provide an appropriate resistance, for example, due to friction to the belt 8. By the same token, the take-up roller 3 must provide an appropriate resistance to the belt 8 when the belt 8 is to be rewound to the supply roller 4.

In the illustrated embodiment, a cleaning blade **13*a* applies a resistive force to the belt 8 when it is rewound to the supply roller 4. A similar element or any other element may be provided to impart an appropriate resistive force to the belt 8 when it is driven to be wound around the take-up roller 3**.

Figure 3:
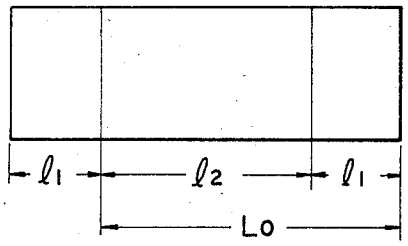
FIG. 3 is a plan view of the photosensitive belt when extended in a plane.

FIG. 3 shows the photosensitive belt 8 employed in the copier 1 of FIG. 1 and it includes an imaging section of length $l_2$ and leading and trailing sections of length $l_1$ provided as connected to the leading and trailing ends of the imaging section, respectively. It is assumed that the imaging section corresponds to A3 size paper, and, thus, $l_2 = 420$ mm. If $l_1 = 150$ mm, the total length of the belt 8 to be wound is $L_0$ which is equal to 570 mm in the present example. That is, the total length of the belt 8 is 720 mm. The relation between the total length to be wound $L_0$ and the number of revolutions n of the belt 8 may be approximately expressed as follows:

$$L_0 = (R_x + nt)\, n\pi \tag{3}$$

Here, $R_x$ is the diameter of take-up roller 3 or supply roller 4. If equation (3) is rearranged for n, we have $$n = \frac{-\pi R_x \pm \sqrt{\pi^2 R_x^2 + 4\pi t L_0}}{2\pi t} \quad (4)$$

where, n is larger than 0.

Now, if the diameter of take-up roller 3 is set as $R_x = 30$ mm, then the number of revolutions $n_1$ at the take-up roller 3 may be determined by substituting $t = 0.095$ and $L = 570$ mm into equation (4) as $$n_1 = 5.94 \quad (5)$$

Similarly, if the diameter of supply roller 4 is set as $R_x = 20$ mm, then the number of revolutions $n_2$ at the supply roller 4 may be determined as $$n_2 = 8.69 \quad (6)$$

Figure 4:
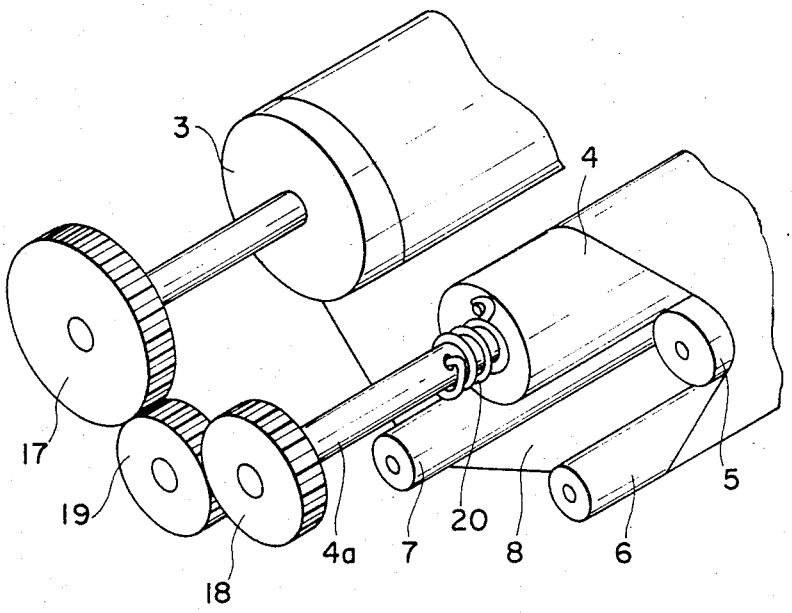
FIG. 4 is a perspective view showing the structure for operating the photosensitive belt more in detail.

As shown in FIG. 4, gears 17 and 18 having $N_1$ and $N_2$ number of teeth, respectively, are fixedly mounted on the shafts which also support the take-up roller 3 and supply roller 4, respectively. Also provided is an idler gear 19 interposed between and in mesh with the gears 17 and 18, so that both of the rollers 3 and 4 are driven to rotate in the same direction. Thus, when the gear 17 executes N number of revolutions, the gear 18 makes $(N_1/N_2)N$ number of revolutions. In the case where $N_1 = 31$ and $N_2 = 20$, when the take-up roller 3 makes 5.94 number of revolutions, then the supply roller 4 makes $(N_1/N_2)N = 9.2$ number of revolutions. This will produce a difference in the number of revolutions by $9.2 - 8.69 = 0.51$. In order to keep the photosensitive belt 8 always in tension by absorbing this difference in the number of revolutions, in the embodiment illustrated in FIG. 4, it is so structured that the supply roller 4 is rotatably supported on and coupled through a spring 20 to its shaft 4*a*. With such a structure, the take-up and rewind operation may be carried out quite smoothly without imparting an additional force, for example, by friction, though the photosensitive belt 8 is kept in tension at a relatively high level.

Figure 5:
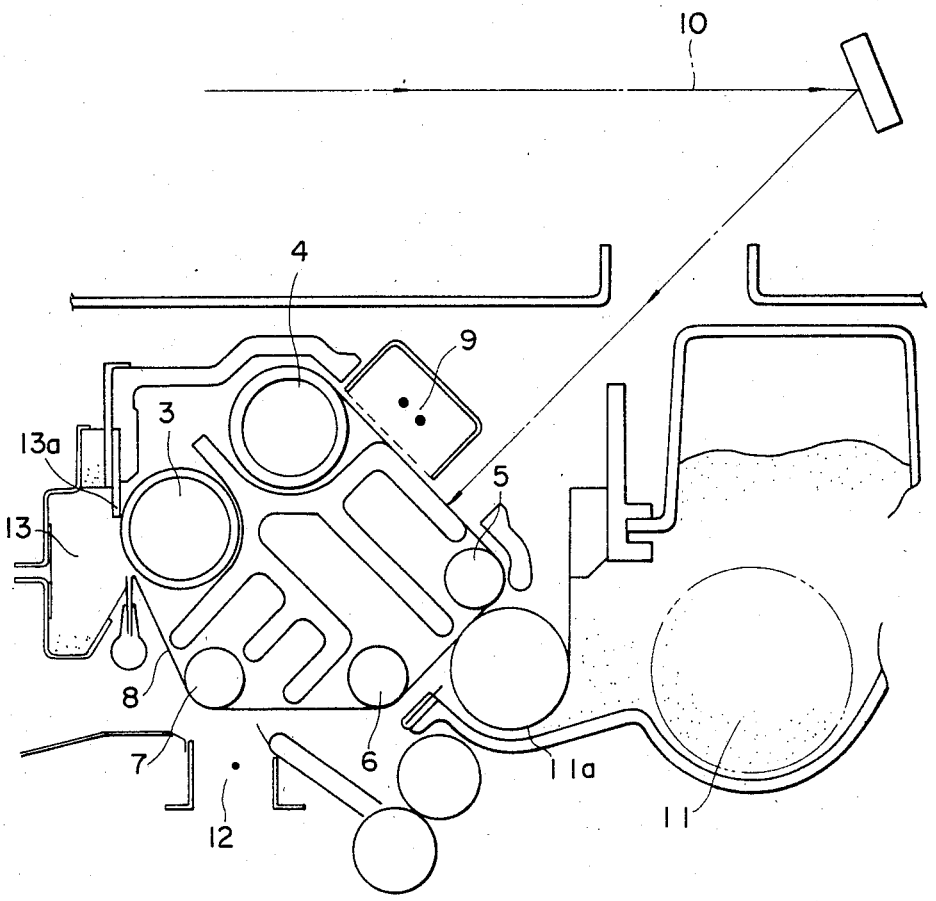
FIG. 5 is a partial schematic illustration showing a modified structure.

FIG. 5 shows another embodiment of the present invention in which a light image from an original does not directly impinge on the photosensitive belt 8 but it first proceeds horizontally and then reflected by a mirror to the photosensitive belt 8 which runs obliquely between the supply roller 4 and the intermediate roller 5. Thus, the layout of various elements provided in the cassette is somewhat different from that of the previous embodiment shown in FIG. 1. It is to be noted, however, that like elements are indicated by like numerals.

As described in detail above, in accordance with the present invention, the photosensitive cassette housing therein a web-type photosensitive member may be made compact in size and low in cost. Furthermore, replacement of such cassettes may be carried out quite smoothly and easily. In addition, the degree of freedom in the layout of various elements is high, which gives more freedom in designing. Besides, the web-type photosensitive member can be driven to travel at constant speed without provision of an extra device therefor.

While the above provides a full and complete disclosure of the preferred embodiments of the present invention, various modifications, alternate constructions and equivalents may be employed without departing from the true spirit and scope of the invention. Therefore, the above description and illustration should not be construed as limiting the scope of the invention, which is defined by the appended claims.

What is claimed is:

1. A copying machine comprising:

a housing:

a cassette which may be detachably mounted in position in said housing and which is provided with a take-up roller, a supply roller and a photosensitive web extending between said take-up roller and said supply roller, said web including a first section for forming a reproduced image thereon, a second section extending between said take-up roller and one end of said first section and a third section extending between said supply roller and an opposite end of said first section, whereby said web travels from said supply roller to said take-up roller during a copying operation and is rewound from said take-up roller to said supply roller to be set ready for the next cycle of copying operation;

means for rewinding said photosensitive web between each copying cycle; and imaging means disposed in said housing for forming said reproduced image on said first section of said web.

2. The copying machine of claim 1 wherein said cassette is further provided with a plurality of intermediate rollers for guiding the advancement of said web between said take-up roller and said supply roller.

3. The copying machine of claim 1 wherein said imaging means includes latent image forming means for forming an electrostatic latent image on said first section of said web and developing means for developing said latent image thereby converting said latent image into a visible image.

4. The copying machine of claim 3 further comprising image transfer means for transferring said developed image to a transfer medium which is moved in association with the movement of said web.

5. The copying machine of claim 1 further comprising means for applying a resistance force against the movement of said web when said web travels between said take-up and supply rollers.

6. The copying machine of claim 5 wherein said means for applying a resistance force includes a cleaning blade disposed in said housing, said cleaning blade imparting a resistive force when said web travels from said take-up roller to said supply roller.

7. The copying machine of claim 6 wherein said supply roller is rotatably supported on a supporting shaft and said means for applying a resistance force includes a spring interposed between said supply roller and said supporting shaft.

8. The copying machine of claim 4 wherein said first section is as long as said transfer medium of a maximum size which may be usable in said copying machine.

* * * * *